US005689857A

United States Patent [19]

Miller

[11] Patent Number: 5,689,857

[45] Date of Patent: Nov. 25, 1997

[54] AIR CUSHION CLEANER

[75] Inventor: Laurence O. Miller, Vernon, Tex.

[73] Assignee: Kinlau Sheet Metal Works, Inc., Vernon, Tex.

[21] Appl. No.: 658,408

[22] Filed: Jun. 5, 1996

[51] Int. Cl.[6] ..... D01B 1/00; D01G 9/08

[52] U.S. Cl. ..... 19/200; 19/65 R; 19/204

[58] Field of Search ..... 19/65 R, 200, 19/204, 205; 209/136, 143, 720, 643, 644

[56] References Cited

U.S. PATENT DOCUMENTS

| | | | |
|---|---|---|---|
| 233,847 | 11/1880 | Groom . | |
| 1,540,200 | 6/1925 | Tyler | 19/200 X |
| 2,702,261 | 2/1955 | Bacon et al. | 19/65 R X |
| 2,809,401 | 10/1957 | Avery | 19/65 R X |
| 2,883,709 | 4/1959 | Deems et al. | 19/204 X |
| 4,229,286 | 10/1980 | Bridges | 19/200 X |
| 4,258,455 | 3/1981 | Werner | 19/200 X |
| 4,300,267 | 11/1981 | Winch et al. | 19/200 |
| 4,301,573 | 11/1981 | Gunter et al. | 19/200 |
| 4,479,286 | 10/1984 | Brown et al. | 19/200 |
| 4,519,114 | 5/1985 | Rhyne | 19/200 |
| 4,625,368 | 12/1986 | Leifeld | 19/200 |
| 4,637,096 | 1/1987 | Wise et al. | 19/200 |
| 4,699,049 | 10/1987 | Mizer | 19/200 X |
| 4,854,013 | 8/1989 | Pinto et al. | 19/200 |

*Primary Examiner*—John J. Calvert
*Attorney, Agent, or Firm*—Wendell Coffee

[57] ABSTRACT

Seed cotton is carried by an airstream into an upright cleaning chamber. Dust and fine trash is carried off through a fine screen in the top of the chamber. The airstream carrying the seed cotton into the chamber will lack sufficient strength to carry the cotton to the fine screen through which the dust and fine trash is carried. The air is separated from the dust and fine trash in a cyclone separator. Larger trash is blown through or carried through a grid on the side of the chamber. The cotton falls to the bottom of the chamber and is carried off with a majority of the air. The fine trash and coarse trash are dropped into a conveyor to be removed.

15 Claims, 3 Drawing Sheets

SUCTION SOURCE
COTTON IN HOT AIR STREAM
COTTON SUCTION SOURCE
34
43
44
35
17
18
24
22
19
20
46
16
30
32
26
48
12
36
10
9
40
14
11
38
42
37
28
39
2
2

AIR CUSHION CLEANER

REFERENCE TO PRIOR FILING (1) Disclosure Document Retention

Applicant filed Disclosure Document Number 368,256 on 9 Jan. 1995 which document concerns this application; therefore, by separate paper it is respectfully requested that the document be retained and acknowledgment thereof made. (MoPEP 1706)

(2) Prior Provisional Application

Applicant also filed a Provisional patent application Ser. No. 60/000114 on Jun. 9, 1995. Applicant relates this application back to said provisional application, and incorporates the contents of said application herein as if set forth in its entirety.

BACKGROUND OF THE INVENTION (1) Field of the Invention

This invention relates to cleaning seed cotton and more particularly to cleaning seed cotton as it arrives at a cotton gin as a first or early step in preparation for separation of the lint and the seed.

(2) Description of the Related Art

As used herein, the term "cotton" refers to "seed cotton".

In cleaning cotton it is desirable to remove as much trash in the form of dry crumbled leaves, sticks, branches, stems, burrs, and other trash as early as possible. Some trash particularly such as dry crumbled leaves are more difficult to remove if they have been "beaten" into the lint by some of the equipment. Specifically, it is believed sometimes that the moving of the cotton by spiked rollers tend to embed fine leaf trash into the cotton lint so that it is much more difficult to clean by subsequent steps of cleaning.

SUMMARY OF THE INVENTION (1) Progressive Contribution to the Related Art

This application discloses a air cleaner wherein the cotton is blown into a cleaning chamber at a velocity so that the majority of the cotton does not reach the top of the cleaning chamber but is directed to the back panel of the cleaning chamber which has a grate or grille. The grille is comprised of vertical spaced part bars. The cotton wipes across the bars in its downward decent and the trash passes through the bars. At least some of the air goes upward through a screen at the top of the cleaning chamber. The seed cotton falls to the bottom of the cleaning chamber to be transported to the next step of the ginning process. In certain cases the seed cotton is carried by heated air or air that has otherwise been conditioned to modify the moisture content of the cotton.

(2) Objects of this Invention

An object of this invention is to remove as much trash from seed cotton as possible as early as possible in a cotton gin before it has been subject to any process which would tend to "beat" the trash into the lint.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

CATALOGUE OF ELEMENTS

Figures 1, 2:
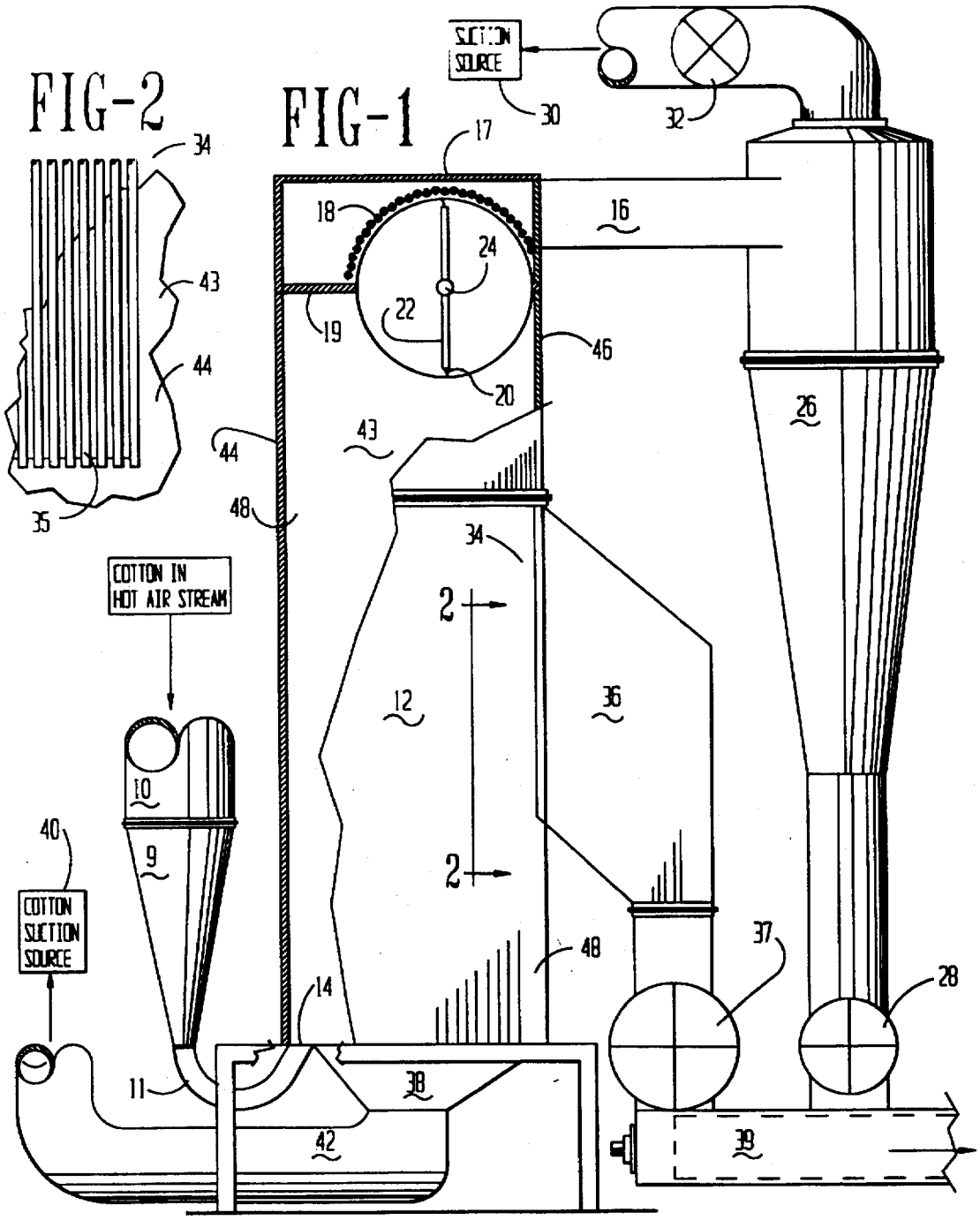
FIG. 1 is an elevational view of first embodiment according to this invention which functions as a cleaner-dryer, with parts broken away to show details of construction.
FIG. 2 is a detail of grid bars taken on Line 2—2 of FIG. 1.

As an aid to correlating the terms used herein to the exemplary drawing(s), the following catalog of elements and steps is provided:

9 transition
10 duct
11 wide duct
12 chamber
14 inlet
16 outlet
17 top
18 fine trash screen
19 partitions
20 wiper
22 arm
24 shaft
26 cyclone
28 vacuum dropper
30 fine trash suction
32 fine trash air valve
34 grille
35 rails
36 coarse trash air collector
37 coarse trash dropper
38 chamber bottom
39 trash conveyor
40 cotton suction
42 cotton duct
43 cleaning chamber
44 front panel
46 back panel
48 side panels
108 transition
110 duct
111 wide dict
112 vessel
114 inlet
118 fine trash screen
120 wiper
122 arm
124 shaft
136 coarse air collector
137 coarse trash valve
138 chamber bottom
143 cleaning chamber
144 front panel
146 back panel

148 side panels
150 top plenum
152 wide duct
154 dirty air suction out
156 dirty air suction source
158 cotton airlock
160 blast box
162 feed rollers
164 hot air source

DESCRIPTION OF THE PREFERRED EMBODIMENTS

Referring to FIG. 1, cotton is carried within duct 10 by an airstream. The duct may receive the cotton as the first step of processing or the cotton may have been dried by dry warm air before entering the duct 10. As illustrated, the cotton has had a cleaning step before this.

The duct 10 has a round configuration. The duct 10 connects to transition section 9 which connects to narrow, wide duct 11. The narrow, wide duct 11 is connected to upright chamber or vessel 12.

The cotton is blown or sucked into the upright chamber 12. The flat duct 11 at inlet 14 in the chamber 12 is be directed upward. Thus, the cotton in its airstream is directed upward. The cotton moves upward through the chamber, and by gravity along with other forces such as the change in the airstream, returns back downward.

A portion of the air is removed from the chamber 12 at air outlet 16 which is at or near the top of the chamber. The air leaving by outlet 16 first passes through fine trash grid or screen 18 to prevent the loss of any cotton or lint. The air exiting through the outlet 16 will carry dust and fine trash which is carried through the screen 18 by the airstream upward. The amount of air withdrawn through the outlet 16 is adjusted so that locks of cotton do not impinge upon the screen 18.

The locks of cotton may contact the screen 18 but the contact they have with it would not be considered an impingement. It is desired that the screen 18 be wiped or doffed by wiper 20. One embodiment of the wiper illustrates the wiper located upon arm 22 connected to horizontal shaft 24. The wiper travels in a circular pattern and therefore it is desirable that the screen 18 be a hemi cylinder covering the upper portion of the travel of the wiper 20. The screen 18 is supported in the chamber 12 by suitable partitions 19.

The air from the outlet 16 travels into cyclone separator 26. The principle air outlet from the cyclone is upward from the center of the cyclone which will be relatively clean air. Most of the dust and trash will be separated and fall to the bottom of the cyclone where it is dropped through vacuum dropper 28 for disposal. The movement of the air from the outlet 16 will be to a source of fine trash suction 30. Fine trash air valve 32 located between the outlet 16 and the source of fine trash suction 30 may regulate the amount of air removed. As indicated above, this amount of air will be regulated so that a maximum amount of fine dust and trash and a minimum amount of cotton will move through the fine trash screen 18.

Grille or grate 34 is located in a side of the chamber 12. The grille is preferably made by a series of upright or vertical rails 35. The clearance between the rails is small enough so that little or no cotton passes through the grille but is wide enough so that sticks, limbs, and stems and other larger heavier trash will move through the grill. Coarse trash air collection chamber 36 is attached to the side of the chamber 12 over the coarse trash grille or grate 34.

The inlet 14 into the chamber is angled at about 10 degrees from vertical. The angle may vary from 10 degrees. The purpose of the deviation of the inlet from vertical is to project the cotton upward so that it arcs or arches to about the wiper 20. Then on its downward travel, the cotton and trash will be carried against the grille 34. The inertia of the cotton and trash against the grille 34 will carry much of the trash (sticks, limbs, stems, etc.) between the rails 35 but only a minimum amount of cotton. Thus, it will be seen that the design of the equipment will vary the optimum angle from 10 degrees. The equipment design includes, height and width of chamber 12; the velocity of entering cotton; and other factors.

The chamber or vessel 12 has a top 17 and four panels. The top of the cleaning chamber 43 is defined by the fine trash screen 18. The bottom of the cleaning chamber is defined by the bottom of panels 44, 46, and 48. Panel 44 is the front panel and panel 46 is the back panel. The distance from the front panel to the back panel is the width of the cleaning chamber. The side panels 48 are connected between the front and rear panels. The distance between the side panels is the width of the cleaning chamber. It is noted that the inlet 14 is below the top 18 of the cleaning chamber 43. As illustrated, the inlet 14 is at the bottom of the front panel which is as stated above below the top of the cleaning chamber.

The typical dimensions of the cleaning chamber would be 48" thick and 84" wide. The preferred height of the cleaning chamber is about 14'. As be readily understood that this would be more than three times the width. The minimum height of the cleaning chamber would be at least twice the width or given the width as 48" the minimum height would be 8 feet. The cotton should move upward and arch before striking the fine screen 18, it is necessary to have the height greater than the minimum twice the width. And as stated, the preferred height is greater than three times or greater than 12 feet. However, as stated above, considering the equipment design there can be variations in these figures.

Because of the location of the inlet 14 and the flow of the cotton there will be a downward flow of cotton along the grid bars 34. This downward flow of material along the grid bars 34 will wipe the grid bars clean. That is to say, the material being processed within the chamber 12 will form as a wiper of the grid bars 34 and it will not be necessary to have a blade similar to the blade 20 which wipes the fine screen 18 clean.

Coarse air dropper 37 is connected to the bottom of the coarse trash chamber 36. Trash conveyor 39 runs below dropper 28 and dropper 39 and receives trash from each. The conveyor 39 is a typical trash conveyor such as an auger conveyor which carries the trash for disposal. The dropper 37 is necessary to prevent there being a flow of air from the course trash collector 36 into the cleaning chamber 43. Actually it is desired that there be a slight air flow from the cleaning chamber 43 into the course trash collector 36. However it is necessary to prevent a net air flowing from the trash container back into the cleaning chamber. By net air flow it is meant that more air will flow in one direction than the other. Because of the configuration of the equipment there may be eddies of current and there may be portions of the grille or grate 34 where the air flows from the trash into the chamber but over the entire area of the grate 34 there will be more air out of the cleaning chamber rather than into the cleaning chamber through this grill.

The cleaned cotton falls into funnel shaped bottom 38 of the chamber 12. The bottom 38 is connected through the cotton duct 42 to cotton source of suction 40. The cotton carried in the airstream within cotton duct 42 will be further processed and the cotton separated from the airstream according to the individual design of the particular gin in which this air cushion cleaning chamber 12 would be installed.

It will be understood by those skilled in the art that all of the sources of suction will eventually be a fan or fans. It would be possible that all of the sources of suction could all be the inlet of the same fan. The different air flows are adjusted by suitable valves as between the outlet and the source of suction regardless of the source of suction. Separate fans could be used. The design of the valves and the fans and the cyclone are all well understood by those having skill in the art and will not be discussed further here. From the above it may be seen that what has been described would be well-suited to be a cleaner dryer. If the conditioned air that is fed into duct 10 is hot air, the hot air within the cleaning chamber 43 would be mixed with the cotton and dry the cotton.

Figure 3:
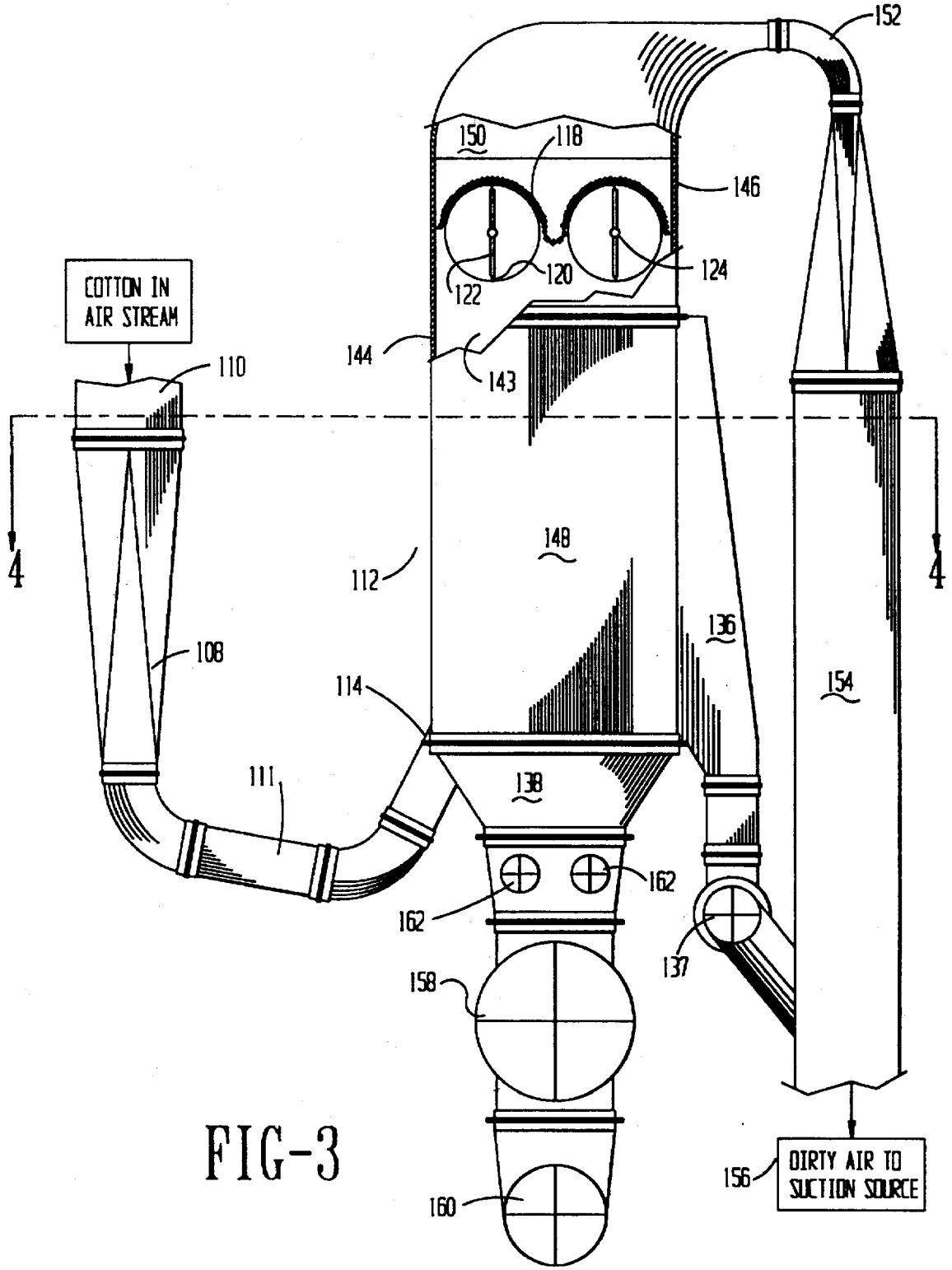
FIG. 3 is an elevation view of a second embodiment which functions as a cleaner-separator.

Now referring to FIG. 3 there may be seen an embodiment that is described as a cleaner separator. This embodiment cleans the cotton while separating the cotton from the airstream. It would be better suited to be placed so that the incoming cotton in duct 110 would be from the cotton as it immediately entered into the processing at the cotton gin. The cotton would be directed into a transition 108 and through wide duct 111 into the cleaning chamber 143 by the inlet 114. Again it may be seen that the inlet is below the top of the cleaning chamber, in as much as again its at the bottom of the cleaning chamber.

Figure 4:
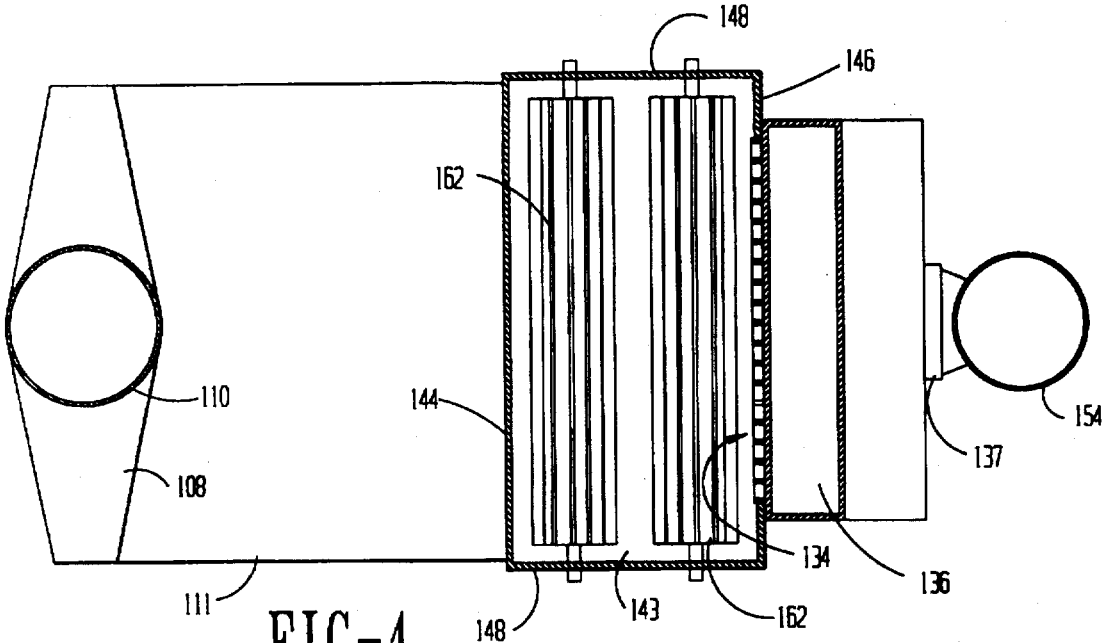
FIG. 4 is a sectional view taken substantially along lines 4—4 of FIG. 3.

The cleaning chamber again would have the front panel 144, back panel 146, and the two side panels 148. This is particularly well shown in FIG. 4 of the drawings. As before, the thickness is defined as the distance from the front panel to the back panel and the width is defined as from one side to the other and the height of the cleaning chamber 143 would be from the bottom of the panels to the fine screen 118. As may be seen in FIG. 3, the screen is included in two hemicylindrical screens, (the hemicylinder being a segment of the cylinder) again there would be a pair of shafts 124 carrying arms 122 with wipers 120 which wipe any lint which might gather on the screen.

A grille or grate 134 has not been shown in detail in as much as it would be similar if not identical to the grille 34 as illustrated in FIG. 2. Also, the relationship of height to the thickness would be the same as previously described which is the preferably the height being 3½ times the thickness but as a very minimum the height would be twice the thickness. In the embodiment of the cleaner separator all but a very small percentage of the air is taken from the top and collected in a top plenum 150 there the air is collected from a wide duct 152 into the dirty air suction outlet 154. A course trash collector 136 is attached to the outside of the back panel 146 to collect the trash therein. At the bottom of this collector, a course trash valve 137 prevents losing excessive air. The outlet from the valve 137 is connected into the suction outlet 154. Those having ordinary skill in the art, realize that there would be a lower pressure in the dirty air suction outlet 154 the air pressure within the cleaning chamber 143. Therefore there will be some leakage or air bleed through the trash valve 137 and therefore there will be a net air movement from the chamber into the course trash collector 136. The dirty air suction outlet 154 is connected to a dirty air suction source 156 which would be the inlet of a fan. Likewise, the cotton from the cleaning chamber 143 would be collected into the funnel-shaped cotton collector 138 below the bottom of the cleaning chamber. In this embodiment the cotton is fed into airlock 158. The cotton would be dropped from the airlock 158 into a conveyor such as the blast box 160 immediately below it.

The cotton is preferably uniformly fed by feed rollers 162 between the funnel 138 and the airlock 158.

Figure 5:
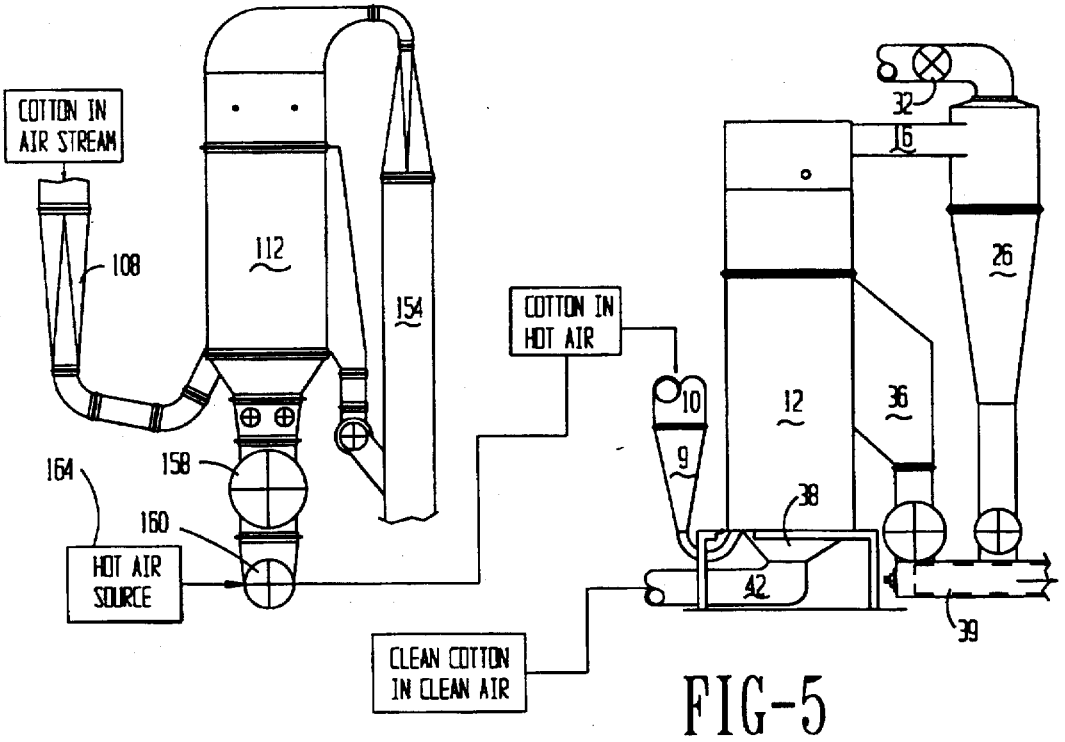
FIG. 5 is a schematic representation of a combination of a cleaner-separator and a cleaner-dryer.

The cleaner-separator and cleaner-dryer may be arranged shown in schematically in FIG. 5. The schematic FIG. 5 shows a cleaner separator vessel 112 whereby the air is heated by hot air source 164 which picks up the cotton at the box 160 at the bottom of the chamber 112 and carries it to the inlet duct 10 of a cleaner dryer chamber 12.

The chambers 12 or 112 could be a cylinder having a circumference which would also be its girth. The cross-sectional shape could be other than that of a circle and the girth would be the measurement around the middle. Normally, the chamber 12 will have the same cross-sectional area from the top of the bottom funnel 38 to the fine trash screen 18. If the chamber is cylindrical it is basically the height would be greater than one-half of the circumference or girth.

Thus, it may be seen that a cleaning equipment has been provided which handles the cotton with a air cushion. The cotton is handled exceedingly gently and none of the fine trash would be imbedded into the cotton fiber during the cleaning process with this equipment. The cotton will contact wiper 20 as the only moving part.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

The process of floating the cotton on air naturally causes the dust and leaves and trash to separate from the bottom.

I claim:

1. An air cushion cleaner for seed cotton comprising:

a) a vessel having a top, a bottom, and four panels extending from top to bottom, the vessel having a height, thickness and width, and is defined by an upper portion and a lower portion, b) a distance from the top to bottom being the height, c) a front panel and a back panel being two of the four panels, with a distance from the front to the back panel being the thickness, d) two side panels being two of the four panels with a distance between the side panels being the width, e) a cleaning chamber between the top, bottom, and four panels, f) a screen at the upper portion of the vessel said screen defining a top of the cleaning chamber, g) an inlet in the bottom portions of the front panel angled away from vertical upward toward the back panel, h) inlet means connected to the inlet for blowing seed cotton carried in an air stream into the chamber, I) a grate in the back panel, j) a trash collector attached outside the chamber to the back panel, k) a seed cotton outlet below the bottom, l) a conveyor means connected to the cotton outlet for moving seed cotton from the chamber, m) a dirty air outlet above the top, and n) a dirty air duct means connected the dirty air outlet for moving at least a portion of the air from the inlet means from the chamber.

2. The cleaner as defined in claim 1 wherein o) said grate is formed as a coarse trash grate of vertical rails in the back panel, p) said rails spaced so as to permit trash to pass through and to prevent locks of seed cotton from escaping.

3. The cleaner as defined in claim 1 wherein o) said screen is formed as a segment of a cylinder, and further comprising:

p) a wiper below the screen, means connected to the wiper for rotating the wiper whereby an edge of the wiper wipes across the screen cleaning debris from the screen.

4. The cleaner as defined in claim 1 further comprising: said inlet means and said height so constructed and arranged that less than 5% of the seed cotton touches the top screen.

5. The cleaner as defined in claim 1 further comprising: at least one cyclone cleaner is connected above the dirty air outlet.

6. The cleaner as defined in claim 1 further comprising: a vacuum box between the cotton outlet and the conveyor means.

7. The cleaner as defined in claim 1 wherein the cleaner is so constructed and arranged there is no net air exchange from the trash collector into the cleaning chamber.

8. The cleaner as defined in claim 7 further comprising:

o) an air bleed from the trash collector into said dirty air outlet.

9. The cleaner as defined in claim 1 further comprising: means for conditioning air contained in said inlet means for blowing seed cotton thereby modifying the moisture content of the seed cotton within the chamber.

10. The cleaner as defined in claim 9 further comprising: a source of seed cotton suction connected to the seed cotton outlet.

11. The cleaner as defined in claim 1 wherein the height of the cleaning chamber is at least about twice the width.

12. The cleaner as defined in claim 11 wherein the height of the cleaning chamber is at least three times the width.

13. An air cushion cleaning system for seed cotton comprising:

a) a first vessel having a top and a bottom, wherein the vessel has an upper portion and a lower portion, b) a distance from the top to the bottom being a height, c) a cleaning chamber between the top and the bottom, d) a screen at the upper portion of the vessel said screen defining a top of the cleaning chamber, e) a grate in the cleaning chamber, f) an inlet below the top angled away from vertical upward toward the grate, g) inlet means connected to the inlet for blowing seed cotton carried in an air stream into the chamber, h) a trash collector attached outside the chamber and in communication with the grate, I) a dirty air outlet above the top, j) a dirty air duct means connected to the dirty air outlet for moving at least a portion of the air from the inlet means from the chamber, k) a seed cotton outlet below the bottom, and l) a blast box connected to the cotton outlet, m) a second vessel having the structure defined in subparagraphs a) through k) above, n) a hot air source connected to the blast box, and o) the blast box connected to the inlet of the second vessel.

14. The method of cleaning seed cotton carried in an airstream comprising:

a) introducing the cotton in the airstream toward a top of a cleaning vessel and moving the cotton against a grate of parallel bars, b) permitting trash, sticks, and limbs to pass through the bars, c) placing the bars sufficiently close together so that cotton does not go through the bars, d) causing the cotton to move along the bars so that the cotton wipes the bars clean and prevents trash from building up on the bars, e) pulling dust and light trash upward by an airstream from the seed cotton, f) permitting the cotton to fall downward while the dust and light trash are carried upward through the screen, and g) transporting the cotton that falls downward to subsequent processing equipment.

15. The method defined in claim 14 further comprising:

h) moving the seed cotton downward as it moves against a grate.

* * * * *